US010069219B2

(12) United States Patent
Huehner et al.

(10) Patent No.: US 10,069,219 B2
(45) Date of Patent: Sep. 4, 2018

(54) PLUG-TYPE CONNECTION HAVING A CONICAL CLAMPING RING CLAMPING A CONICAL COLLET

(71) Applicant: Robert Bosch GmbH, Stuttgart (DE)

(72) Inventors: Stefan Huehner, Kusterdingen (DE); Adolf Dillmann, Muensingen (DE); Reiner Holp, Winterlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/553,327

(22) PCT Filed: Jan. 13, 2016

(86) PCT No.: PCT/EP2016/050501

§ 371 (c)(1),
(2) Date: Aug. 24, 2017

(87) PCT Pub. No.: WO2016/134871

PCT Pub. Date: Sep. 1, 2016

(65) Prior Publication Data

US 2018/0123264 A1 May 3, 2018

(30) Foreign Application Priority Data

Feb. 27, 2015 (DE) ..... 10 2015 203 518

(51) Int. Cl.
*H01R 4/50* (2006.01)
*H01R 11/01* (2006.01)
(Continued)

(52) U.S. Cl.
CPC ..... *H01R 4/5016* (2013.01); *H01R 11/28* (2013.01); *H01R 13/111* (2013.01); *H01R 13/193* (2013.01); *H01R 11/289* (2013.01)

(58) Field of Classification Search
CPC ..... H01R 4/20; H01R 4/5016; H01R 4/5083; H01R 4/5025; H01R 11/28; H01R 11/281;
(Continued)

(56) References Cited

U.S. PATENT DOCUMENTS 3,818,422 A * 6/1974 Pertuit ..... H01R 4/36 439/728
4,560,230 A * 12/1985 Inglis ..... H01R 11/289 439/890
(Continued)

FOREIGN PATENT DOCUMENTS

| | | |
|---|---|---|
| GB | 191773 | 1/1923 |
| WO | 2011088902 | 7/2011 |
| WO | 2014076325 | 5/2014 |

OTHER PUBLICATIONS

International Search Report for Application No. PCT/EP2016/050501 dated Mar. 7, 2016 (English Translation, 2 pages).

*Primary Examiner* — Chandrika Prasad
(74) *Attorney, Agent, or Firm* — Michael Best & Friedrich LLP

(57) ABSTRACT

The present invention relates to a plug-type connection (1) for an electrical connection between a first line (2) and a second line (3), comprising a contact bolt (4) which can be connected to the first line (2), a collet (5) which can be connected to the second line (3) and has a cutout (6) for inserting the contact bolt (4), has a conical collet outer face (7) and has at least n slots (8) for forming n clamping jaws, where n≥1, and a clamping ring (9) with a conical clamping ring inner face (10) against which the conical collet outer face (7) bears, wherein the at least one clamping jaw can be clamped against the contact bolt (4) as a result of a relative movement between the collet (5) and the clamping ring (9).

7 Claims, 5 Drawing Sheets

(51) Int. Cl.
*H01R 13/11* (2006.01)
*H01R 13/193* (2006.01)
*H01R 11/28* (2006.01)

(58) Field of Classification Search
CPC ..... H01R 11/289; H01R 11/287; H01R 13/11; H01R 13/111; H01R 13/193; H01R 4/50
USPC ..... 439/783
See application file for complete search history.

(56) References Cited

U.S. PATENT DOCUMENTS

| | | | | |
|---|---|---|---|---|
| 4,925,403 | A * | 5/1990 | Zorzy | H01R 13/6315 439/578 |
| 8,801,459 | B2 * | 8/2014 | Mrowka | H01R 24/54 439/246 |
| 2004/0038586 | A1 * | 2/2004 | Hall | H01R 13/6315 439/578 |
| 2006/0194465 | A1 * | 8/2006 | Czikora | H01R 13/6315 439/248 |
| 2009/0314123 | A1 * | 12/2009 | Kwon | F16C 1/105 74/502 |
| 2010/0040406 | A1 * | 2/2010 | Lenhart | A45B 9/00 403/109.5 |
| 2012/0295478 | A1 * | 11/2012 | Mrowka | H01R 24/50 439/578 |

* cited by examiner

PLUG-TYPE CONNECTION HAVING A CONICAL CLAMPING RING CLAMPING A CONICAL COLLET

BACKGROUND OF THE INVENTION

The present invention relates to a plug connection for an electrical connection.

Contacting systems for electrical connections that can be disconnected between lines are used by way of example in power electronics systems. Typically, plug contacting systems having resilient contacts or screw connections are used. Plug contacts can be joined in a concealed manner, wherein it is necessary for screw connections to be accessible with a screwdriver. However, plug contacts often do not meet the required demands with respect to vibration, for example for control devices in the case of mounting transmissions and mounting engines in a vehicle. It is also to be noted that the plug contact systems cannot be constructed to an arbitrary size. In the automotive industry, the plugging forces are to amount to less than 75 N for manual assembly.

The basic material of the resilient contacts of plug contact systems comprises a poor electrical and thermal conductivity owing to the resilient characteristics that are required. The contact surfaces are usually punctiform or linear and as a consequence are limited in size to a few square millimeters. An electrical and thermal resistance occurs owing to the poor electrical and thermal conductivity and the small contact surfaces, said electrical and thermal resistance leading to intense heating of the contact system. As a consequence, the current conductivity is limited. The threshold temperature for contact systems is by way of example 180° C.

SUMMARY OF THE INVENTION

In contrast to plug contact systems according to the prior art, the present invention discloses a plug connection in which a contact stud comes into extensive contact over almost the entire periphery with a collet (first and second exemplary embodiment), or a contact sleeve completely comes into contact over the entire periphery with a clamping stud (third exemplary embodiment). In accordance with the invention, there is no point contact or linear contact but rather a planar contact. At the same time, the contact is not a conventional resilient contact so it is possible using particularly small forces to plug in the system in accordance with the invention. It is possible to use highly-conductive copper or aluminum for the basic material so that particularly small electrical and thermal transition resistances occur. A relative movement between the contact stud and collet or between the contact sleeve and clamping stud owing to the heating is prevented by means of the large surface contact and the good thermal conductivity of the basic materials. It is preferred that a pure plugging system and not a screw contact is provided so that it is possible to make the join in a concealed manner, wherein access for a tool is not required. A planar clamping arrangement is produced between the clamping partners so that the plug connection in accordance with the invention withstands high vibration loads. Large clamping forces are produced by means of the wedge effect, as a result of which even relative movements in the μ range are prevented. Furthermore, the plug connection in accordance with the invention renders possible a particularly small construction height since only a small joining depth is required.

All these advantages are achieved by means of a plug connection in accordance with the invention (the plug connection in accordance with the invention can also be referred to within the scope of the entire invention as the contact system) for an electrical connection between two lines. The plug connection comprises (in accordance with the first and second exemplary embodiment) a contact stud that can be connected to the first line and a collet that can be connected to the second line. The plug connection is closed in that the contact stud is inserted into the collet. The collet comprises for this purpose a recess into which the contact stud is plugged. The geometric shape of the recess corresponds to the geometric shape of the contact stud. Moreover, the outer diameter of the contact stud corresponds to the inner diameter of the recess. As a consequence, it is ensured that the contact stud lies with its periphery in the recess.

The collet comprises a conical collet outer surface. At least one slot is embodied in this collet outer surface. This slot is also referred to as an axial slot and said slot extends outwards in the radial direction entirely from the recess through the wall that surrounds the recess. The at least one slot divides the region of the collet that surrounds the recess into at least one clamping jaw. Generally speaking, n slots form n clamping jaws, wherein $n \geq 1$.

Moreover, the plug connection comprises a clamping ring having a conical clamping ring inner surface. The conical clamping ring inner surface lies on the conical collet outer surface. The at least one clamping jaw is braced or pressed against the contact stud by means of a relative movement between the collet and the collet ring. As a consequence, the contact stud is held within the recess of the collet.

In particular, it is provided that the collet is also closed at the same time as inserting the contact stud into the recess. This is achieved in that the relative movement between the collet and clamping ring is performed at the same time as inserting the contact stud.

For this purpose, there are two preferred variants.

In accordance with the first variant (first exemplary embodiment), it is preferably provided that the contact stud and the clamping ring are embodied in such a manner that the collet is pressed into the clamping ring when inserting the contact stud into the recess. The clamping ring is in other words fixed and the collet moves at the same time as inserting the contact stud. For this purpose, in particular a receiving arrangement is provided that is preferably embodied from synthetic material. The clamping ring is fixedly arranged in said receiving arrangement. In particular, the clamping ring is injection molded with the synthetic material of the receiving arrangement. The collet plugs in a movable manner into the clamping ring. Advantageously, the receiving arrangement or a corresponding cover is embodied in such a manner that the collet is received in a loss-proof manner.

There are different preferred possibilities for moving the collet by means of the contact stud: the contact stud can stand on the base of the collet and as a consequence can press the collet. Alternatively, the contact stud can engage with a shoulder on the upper edge or on a section of the collet and as a consequence displace the collet in the direction of the clamping ring.

In the second variant (second exemplary embodiment), it is preferably provided that the contact stud and the clamping ring are embodied in such a manner that after inserting the contact stud into the recess the clamping ring is pressed onto the collet. In other words, the collet is fixed in this variant. If the contact stud is in position, the clamping ring is pressed onto the collet. In particular, a part that is decoupled from the contact stud presses onto the clamping ring. It is preferred that a receiving arrangement is provided that is preferably embodied from synthetic material, wherein the collet is arranged fixed in the receiving arrangement. In particular, a part of the collet is received by the synthetic material of the receiving arrangement as a counter bearing. The clamping ring sits in a movable manner on the collet. The receiving arrangement or a cover are preferably embodied in such a manner that the clamping ring sits on the collet in a loss-proof manner.

Furthermore, the invention comprises (third exemplary embodiment) a plug connection for an electrical connection, wherein a contact sleeve is used in lieu of the contact stud. Accordingly, a clamping stud is used in lieu of the collet. The clamping stud is in turn clamped by way of a mandrel. However, the principle in accordance with the invention remains the same, according to which clamping elements and planar contact partners are used.

In other words, the second plug connection comprises a contact sleeve that can be connected to the first line and a clamping stud that can be connected to the second line. The clamping stud is embodied for inserting into the contact sleeve. The geometric shape of the inner side of the contact sleeve corresponds to the geometric outer shape of the clamping stud. Moreover, the inner diameter of the contact sleeve corresponds to the outer diameter of the clamping stud so that a planar surface is produced. The clamping stud comprises a conical clamping stud inner surface. The clamping stud is divided with at least one slot into at least one clamping jaw. The slot can be referred to in this case also as an axial slot that extends from the conical clamping stud inner surface through the complete surrounding wall towards the outside. n slots in the clamping stud form n clamping jaws with n>=1.

Moreover, a mandrel having a conical mandrel outer surface is provided. The mandrel outer surface lies on the conical clamping stud inner surface, wherein the at least one clamping jaw can be clamped or pressed outwards against the contact sleeve by means of a relative movement between the mandrel and clamping stud.

Advantageously, it is provided that the mandrel is arranged in the contact sleeve. As a consequence, it is ensured that the mandrel is inserted into the conical clamping stud inner surface at the same time as the contact sleeve and clamping stud are inserted into one another and consequently the at least one clamping jaw is pressed outwards at the same time.

The mandrel and the contact sleeve can together form a component that is produced as a single part. Alternatively, it is also possible to use two dedicated components.

Advantageously, copper, brass, bronze or aluminum is used for the contact stud or the contact sleeve and the collet or the clamping stud. The surfaces can be coated with tin, silver, gold or palladium. However, it is preferable not to use an additional surface.

The number n of the clamping jaws both in the case of the collet as well as the clamping stud is advantageously 1, 2, 3, 4, 5 or 6.

Furthermore, the invention comprises a motor vehicle assembly comprising at least one plug connection as described above, wherein the plug connection is arranged in particular on a power electronics system and/or an electrochemical energy storage device and/or an electrical drive system of the motor vehicle. In this field, there are by way of example currents of approximately 20 to 1000 Amps. At the same time, there is a requirement in the automotive industry that connections must be cost-effective to produce and simple to assemble. These requirements are fulfilled by the plug connections proposed here.

In an alternative to the use in the motor vehicle, it is preferably provided that the plug connections in accordance with the invention are used in photovoltaic systems, wind turbines or converters.

In particular, the plug connections in accordance with the invention are suitable for connecting power modules, by way of example inverters.

BRIEF DESCRIPTION OF THE DRAWINGS

Exemplary embodiments of the invention are described in detail hereinunder with reference to the accompanying drawing. In the drawings.

DETAILED DESCRIPTION

Figure 1:
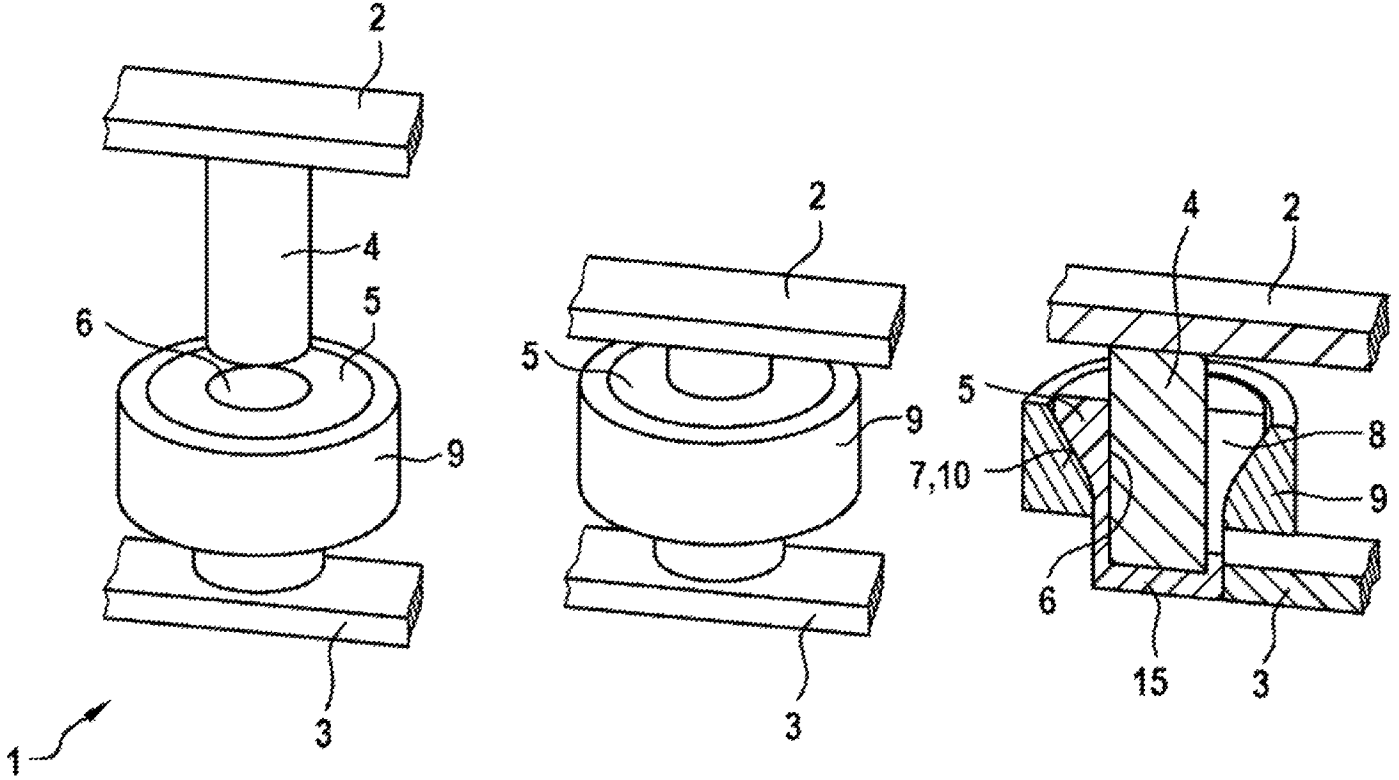
FIG. 1 illustrates multiple views of a plug connection in accordance with the invention in accordance with a first exemplary embodiment.

FIG. 1 illustrates in various states the plug connection 1 in accordance with the first exemplary embodiment. The plug connection 1 is used as a disconnectable electrical connection between a first line 2 and a second line 3. The first line 2 is connected to a contact stud 4. The second line 3 is connected to a collet 5. In particular, it is evident in the sectional view in FIG. 1 that the collet 5 comprises a recess 6. The recess 6 corresponds in its dimensions to the contact stud 4 so that a planar contacting arrangement is produced in the case of an inserted contact stud 4.

Moreover, the collet 5 comprises a conical collet outer surface 7. There is at least one slot 8 in this collet outer surface 7. At least one clamping jaw of the collet 5 is produced by means of the slot 8.

Moreover, the plug connection 1 comprises a clamping ring 9 having a conical clamping ring inner surface 10. The clamping ring 9 plugs onto the collet 5.

A base 15 of the recess 6 is closed so that the contact stud 4 stands on the base 15. As a consequence, when inserting the contact stud 4, the collet 5 moves downwards and consequently relative to the clamping ring 9. The at least one clamping jaw is braced against the contact stud 4 as a result of the conical surfaces 7,10.

Figure 2:
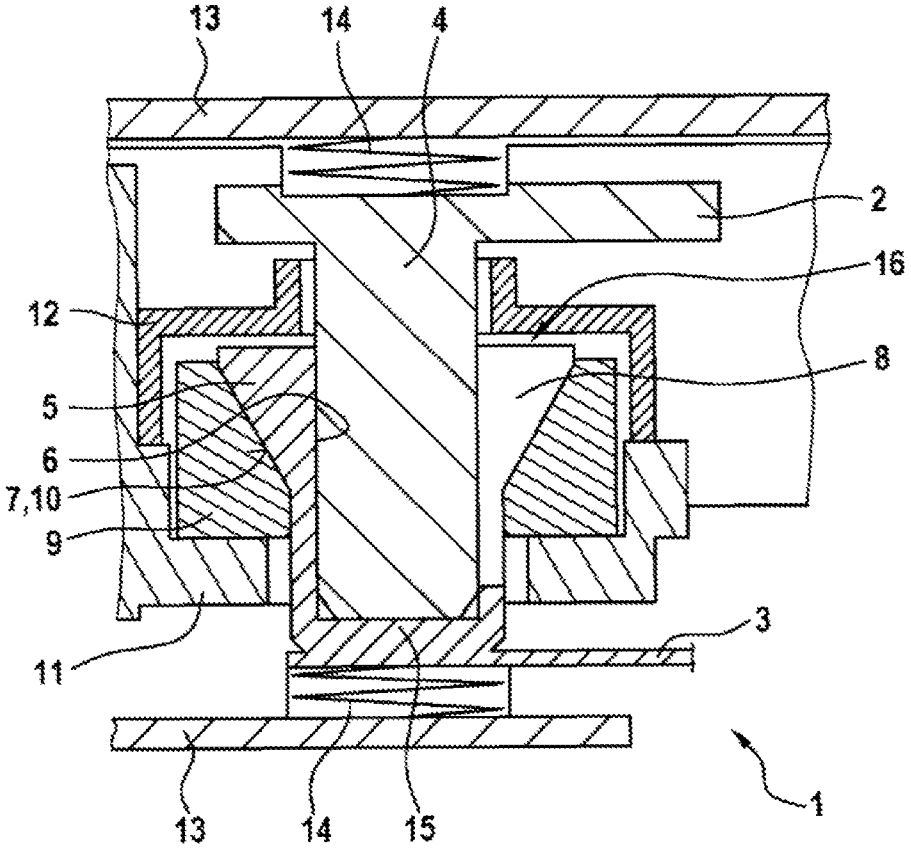
FIG. 2 illustrates a sectional view of the plug connection in accordance with the invention in accordance with the first exemplary embodiment.

FIG. 2 illustrates in detail the plug connection 1 according to the first exemplary embodiment. With reference to this illustration, it is evident that the clamping ring 9 is arranged fixed in a receiving arrangement 11. The receiving arrangement 11 is by way of example a synthetic material, wherein the clamping ring 9 is injection molded. The receiving arrangement 11 is in part closed on the upper side by means of a cover 12. A hole is provided in the cover 12 in order to plug in the contact stud 4. The cover 12 is embodied in such a manner that the collet 5 can move to a certain extent with respect to the clamping ring 9. The cover 12 also simultaneously provides a loss-proof receiving arrangement of the collet 5.

It is preferably provided that multiple plug connections 1 are combined in one plug. For this purpose, the housing 13 that is illustrated schematically can be used. In order to compensate for tolerances in the multiple plug connections 1 that are arranged adjacent to one another, the opposite-lying ends of the contact stud 4 and the collet 5 are supported by way of resilient elements 14 with respect to the housing 13.

Moreover, FIG. 2 illustrates the base 15 against which the contact stud 4 presses in order to move the collet 5 relative to the clamping ring 9 at the same time as inserting the contact stud 4. In an alternative thereto, it is also possible that the contact stud 4 or an element that is fixedly connected to the contact stud 4 presses the upper edge 16 of the collet 5. Furthermore, it is possible that within the recess 6 a corresponding shoulder is provided against which the contact stud 4 presses.

Figure 3:
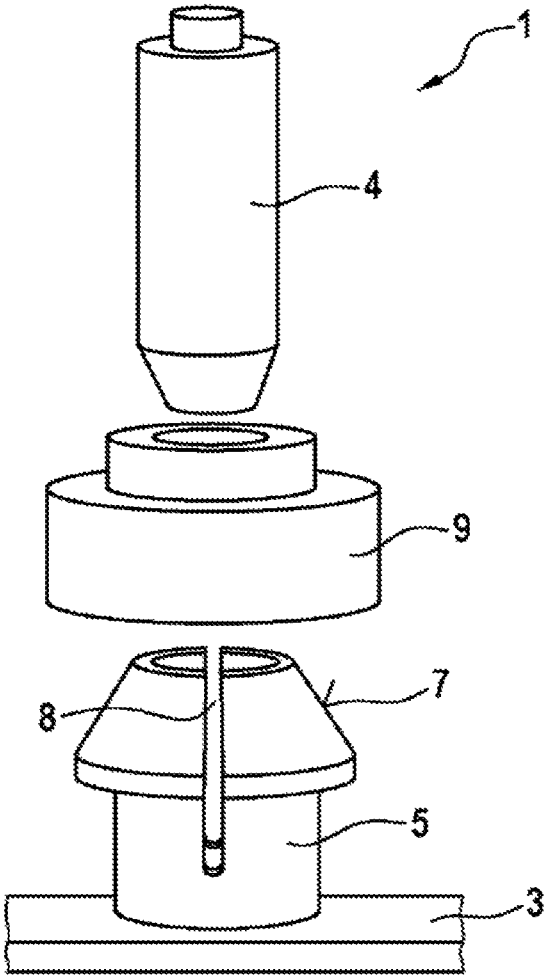
FIGS. 3 and 4 illustrate a plug connection in accordance with the invention in accordance with a second exemplary embodiment.
Figure 4:
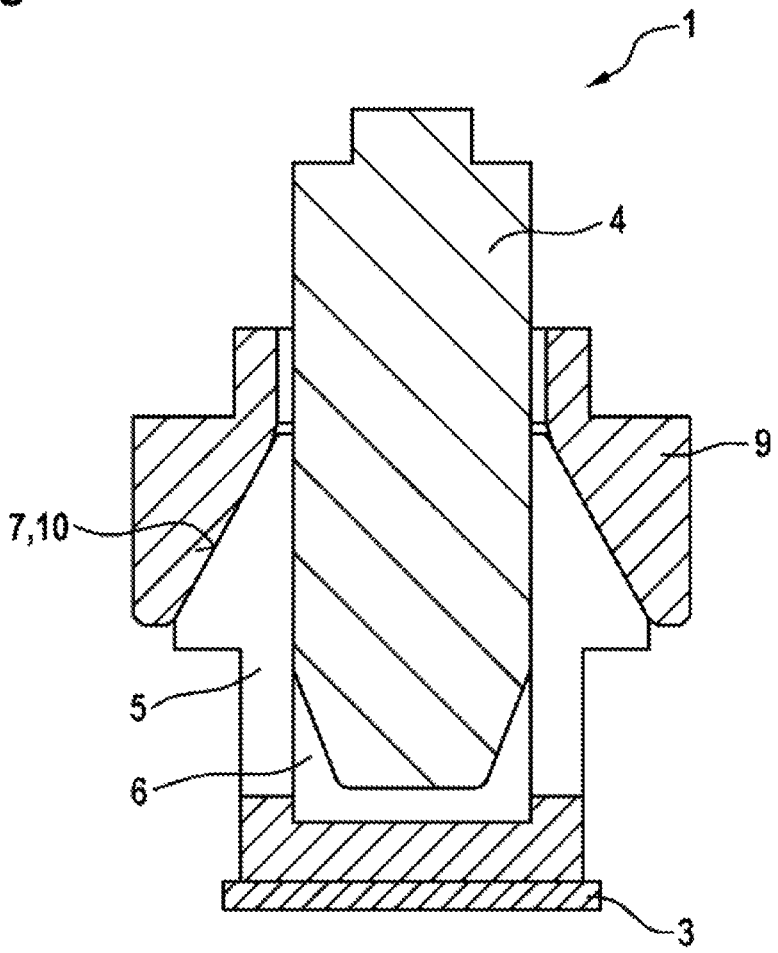

FIGS. 3 and 4 illustrate the plug connection 1 in accordance with the second exemplary embodiment. Identical or functionally identical components in the first exemplary embodiment and second exemplary embodiment are provided with identical reference numerals.

In the second exemplary embodiment, the clamping ring 9 is plugged on from the same side as the contact stud 4. Advantageously, the clamping ring 9 is pressed downwards at the same time as inserting the contact stud 4 and consequently said clamping ring is pressed onto the collet 5. Accordingly, the contact stud 4 does not stand on the base 15.

In the second exemplary embodiment, when plugging in the plug connection 1, the contact stud 4 can press against the clamping ring 9. In addition or in an alternative thereto, the collet 5 is pressed in the opposite direction, in other words against the collet ring 9.

Figure 5:
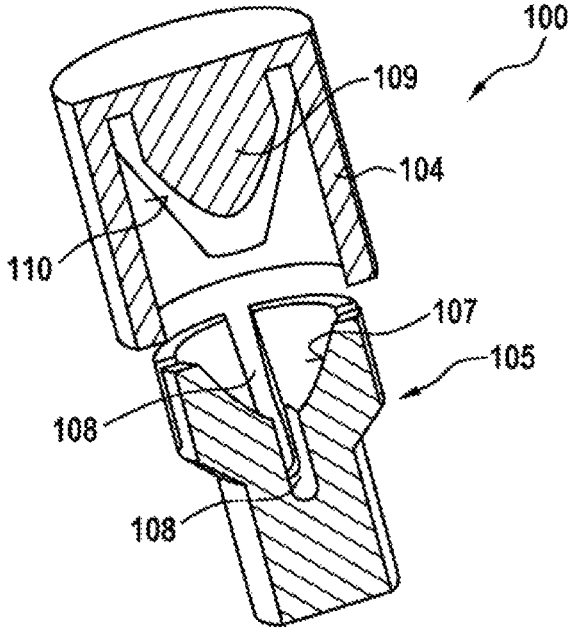
FIGS. 5 and 6 illustrate a plug connection in accordance with the invention in accordance with a third exemplary embodiment.
Figure 6:
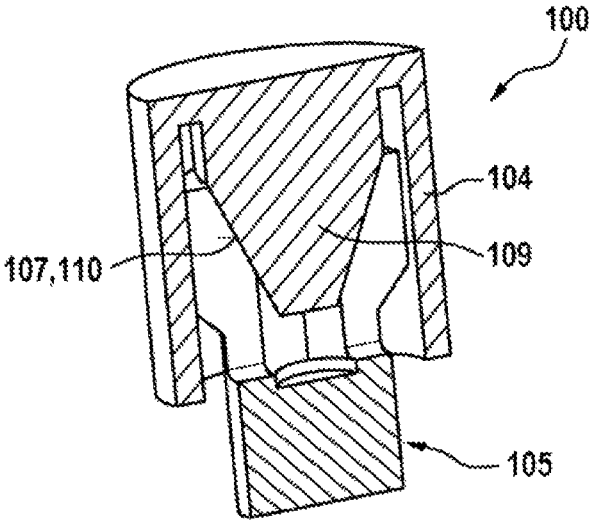

FIGS. 5 and 6 illustrate the plug connection 100 in accordance with the third exemplary embodiment. Also in the third exemplary embodiment, clamping jaws are braced and simultaneously a planar contacting arrangement is produced between the contact partners. In the third exemplary embodiment, a contact sleeve 104 is used in lieu of the contact stud 4. A clamping stud 105 is inserted into the contact sleeve 104. This clamping stud 105 corresponds in its function to the function of the collet 5. The clamping studs 105 in the illustrated exemplary embodiment comprise four slots 108. These slots 108 divide the clamping stud 105 into four clamping jaws. A conical clamping stud inner surface 107 is located in the clamping stud 105. A mandrel 109 is inserted into the clamping stud inner surface 107 so as to push the clamping jaws apart. The mandrel 109 comprises for this purpose a corresponding conical mandrel outer surface 110.

In the illustrated exemplary embodiment, the mandrel 109 is located in the interior of the contact sleeve 104. Consequently, the mandrel 109 is also pressed into the clamping stud 105 at the same time as the relative movement between the contact sleeve 104 and clamping stud 105.

All three exemplary embodiments illustrate a plug connection 1, 100 that can be joined in a simple manner, is able to withstand very high vibration loads, is simple to produce and can be joined using small plugging forces and comprises a low electrical and thermal transition resistance.

What is claimed is:

1. A plug connection (1) for an electrical connection between a first line (2) and a second line (3), the plug connection comprising:

a contact stud (4) configured to be connected to the first line (2), a collet (5) configured to be connected to the second line (3), said collet having a recess (6) configured to receive the contact stud (4), a conical collet outer surface (7), and at least n slots (8) for forming n clamping jaws, with n≥1, and a clamping ring (9) having a conical clamping ring inner surface (10) against which the conical collet outer surface (7) lies, wherein at least one of the clamping jaws is configured to be clamped against the contact stud (4) by a relative movement between the collet (5) and clamping ring (9), wherein the contact stud (4) includes a proximal end configured to be connected to the first line, and a distal end configured to extend into the collet (5), wherein the contact stud (4) extends along an elongate direction from the proximal end toward the distal end, and wherein the conical collet outer surface (7) is configured to converge radially inwardly toward the contact stud (4) in the elongate direction when distal end of the contact stud (4) is extended into the collet (5).

2. The plug connection as claimed in claim 1, characterized in that the contact stud (4) and the collet (5) are embodied in such a manner that the collet (5) is pressed into the clamping ring (9) when inserting the contact stud (4) into the recess (6).

3. The plug connection as claimed in claim 2, characterized by a receiving arrangement (11), wherein the clamping ring (9) is fixedly arranged in the receiving arrangement (11) and the collet (5) is inserted in the clamping ring (9) in a movable manner.

4. A motor vehicle assembly comprising at least one plug connection (1, 100) as claimed in claim 1.

5. The motor vehicle assembly as claimed in claim 4, wherein the plug connection (1, 100) is arranged on a power electronics system and/or an electrical energy storage device and/or an electrical drive system of the motor vehicle assembly.

6. The plug connection as claimed in claim 2, characterized by a receiving arrangement (11) embodied from a synthetic material, wherein the clamping ring (9) is fixedly arranged in the receiving arrangement (11) and the collet (5) is inserted in the clamping ring (9) in a movable manner.

7. A plug connection (1) for an electrical connection between a first line (2) and a second line (3), the plug connection comprising:

a contact stud (4) configured to be connected to the first line (2), a collet (5) configured to be connected to the second line (3), said collet having a recess (6) configured to receive the contact stud (4), a conical collet outer surface (7), and at least n slots (8) for forming n clamping jaws, with n≥1, a clamping ring (9) having a conical clamping ring inner surface (10) against which the conical collet outer surface (7) lies, wherein at least one of the clamping jaws is configured to be clamped against the contact stud (4) by a relative movement between the collet (5) and clamping ring (9), and a receiving arrangement (11), wherein the clamping ring (9) is fixedly arranged in the receiving arrangement (11) and the collet (5) is configured to be inserted in the clamping ring (9) in a movable manner.

* * * * *